US005610552A

United States Patent [19]

Schlesinger et al.

[11] Patent Number: 5,610,552

[45] Date of Patent: Mar. 11, 1997

[54] ISOLATION CIRCUITRY FOR TRANSMITTER ELECTRONICS IN PROCESS CONTROL SYSTEM

[75] Inventors: Morton L. Schlesinger, Bloomington; Bruce E. Kyro, Savage, both of Minn.

[73] Assignee: Rosemount, Inc., Eden Prairie, Minn.

[21] Appl. No.: 508,551

[22] Filed: Jul. 28, 1995

[51] Int. Cl.[6] ..... G06G 7/12

[52] U.S. Cl. ..... 327/560; 327/509

[58] Field of Search ..... 327/4, 560, 561, 327/563, 588, 509

[56] References Cited

U.S. PATENT DOCUMENTS

| | | | |
|---|---|---|---|
| 3,573,774 | 4/1971 | Olsen | 340/199 |
| 3,959,786 | 5/1976 | Chana et al. | 340/210 |
| 4,137,770 | 2/1979 | Trout | 327/588 |
| 4,215,394 | 7/1980 | Galloway et al. | 363/137 |
| 4,527,583 | 7/1985 | Simpson | 137/82 |
| 4,573,040 | 2/1986 | Maltby et al. | 340/511 |
| 4,607,247 | 8/1986 | Sterling, Jr. et al. | 340/310 |
| 4,613,776 | 9/1986 | Ishii | 327/561 |
| 4,691,328 | 9/1987 | Sterling, Jr. et al. | 375/36 |
| 4,714,912 | 12/1987 | Roberts et al. | 340/310 |
| 4,746,897 | 5/1988 | Shuey | 340/310 |
| 4,806,905 | 2/1989 | McGowan, III et al. | 340/310 |
| 4,806,929 | 2/1989 | Nishijima et al. | 340/825 |
| 4,885,563 | 12/1989 | Johnson et al. | 340/310 |
| 4,903,006 | 2/1990 | Boomgaard | 340/310 |
| 4,949,359 | 8/1990 | Voillat | 340/310 |
| 4,967,302 | 10/1990 | Hutcheon et al. | 361/1 |
| 4,973,954 | 11/1990 | Schwarz | 340/825 |
| 5,028,746 | 7/1991 | Petrich | 191/12.2 |
| 5,050,060 | 9/1991 | Geuns | 363/126 |
| 5,136,630 | 8/1992 | Breneman et al. | 379/64 |
| 5,170,081 | 12/1992 | Adachi et al. | 327/560 |
| 5,207,101 | 5/1993 | Haynes | 73/597 |
| 5,333,114 | 7/1994 | Warrior et al. | 364/550 |
| 5,339,070 | 8/1994 | Yalowitz et al. | 340/578 |
| 5,420,578 | 5/1995 | O'Brien et al. | 340/870 |
| 5,493,488 | 2/1996 | Castle et al. | 364/162 |

FOREIGN PATENT DOCUMENTS 2174205 10/1986 United Kingdom .

OTHER PUBLICATIONS

Diagram of "Vortex Intrinisc Safety Isolation", 1 sheet.

"The Significance of EMC to Manufacturers and Users of Industrial Automation Instrumentation", 8130 ATP automatisierrungstechnische Praxis, 34(1992) Oktober, No. 10, Munich, DE.

Catalog: "Applying Intrinsic Safety—Wiring Examples", *Intrinsic Safety Catalog,* Pepperl+Fuchs, 1990, pp. 20, 38–39 and 59.

Catalog: "Mini–Tee™ Connectors", *Quick–Disconnect Systems for Simplified Management of Control System Wiring,* Daniel Woodhead Company (undated), p. 26.

"Safety Barrier Serves Transmitters", I. Hutcheon, *Control & Instrumentation,* vol. 19, No. 11, pp. 79, 81, Nov. 1987.

"Installation Practices: System Approvals, Entity Parameters, I/S Apparatus (field devices), I/S Associated Apparatus (barriers power supplies, I/O cards . . . ), Simple Apparatus, Wire, Use of Entity Parameters," Frank McGowan, Presentation made at Intrinsic Safety Seminar, Jul. 16, 1993.

"A Design Perspective of I.S. and Fieldbus: Pmax, Imax, Ceq (C1), Leg (1), Liftoff Voltage, Quiescent Current, Number of Devices, Handheld Terminals," Ted Schnarre, Presentation made at Intrinsic Safety Seminary, Jul. 16, 1993.

*Primary Examiner*—Timothy P. Callahan
*Assistant Examiner*—Jeffrey Zweizig
*Attorney, Agent, or Firm*—Westman, Champlin & Kelly, P.A.

[57] ABSTRACT

A transmitter in a process control system includes isolation circuitry which isolates transmitter electronics from a sensor bridge circuit. The isolation circuitry includes high impedance isolators in series with high impedance buffers to electronically isolate the transmitter electronics from the bridge. A power supply is isolated using a series of capacitors connected to a periodic signal.

20 Claims, 4 Drawing Sheets

VDD-I
VSS-I
40
188
186
184
182
180
170
174c
178c
192
174b
178b
174a
178a
176
172
FROM 68
58
VSS
38
VDD
100
102
0.8V
104
106
108
110
112
114
116
119a
119b
40
120
118
VDDI
126
124
166
160
150
152
154
OUTPUT
32b
32a
32
32d
32c
INPUT
132
164
134
138
136
194
162
140
156
158
TO 70
TO 88

ISOLATION CIRCUITRY FOR TRANSMITTER ELECTRONICS IN PROCESS CONTROL SYSTEM

BACKGROUND OF THE INVENTION

The present invention relates to process control systems. More specifically, the present invention relates to isolation circuitry for use in transmitters of a process control system Process control systems are used in manufacturing plants to monitor operation of a process. A transmitter is placed in the field and monitors a variable of the process, for example, pressure, temperature or flow. The transmitter couples to a control loop and transmits information over the control loop to a controller which monitors operation of the process. Typically, the control loop is a two-wire loop carrying a current which also provides power for operation of the transmitter. Communication standards include the Fieldbus standard in which digital information is sent to the transmitter. HART® is another standard which allows communication over a 4–20 mA process variable signal.

One type of process variable sensor is a resistance bridge circuit in which the resistance of the bridge varies in response to the process variable. Other sensors include capacitance, vibrating beam, or other. An input signal is applied to the bridge and the bridge output is monitored to determine the process variable. To meet certain Intrinsic Safety standards, the bridge circuit must be "infallibly" electrically isolated from the rest of the transmitter. Such standards are set forth by, for example, European CENELEC standards EN50014 and 50020, Factory Mutual Standard FM3610, the Canadian Standard Association, the British Approval Service for Electrical Equipment in Flammable Atmospheres, the Japanese Industrial Standard, and the Standards Association of Australia. The Intrinsic Safety requirements are intended to guarantee that instrument operation or failure cannot cause ignition if the instrument is properly installed in an environment that contains explosive gasses. This is accomplished by limiting the maximum energy stored in the transmitter in a worst case failure situation. Excessive energy discharge may lead to sparking or excessive heat which could ignite an explosive environment in which the transmitter may be operating.

The prior art has primarily used two techniques to achieve infallible isolation between the sensor circuitry and the transmitter circuitry. The first technique is to provide sufficient mechanical segregation or spacing in the sensor such that it is impossible for a component failure to cause electrical shorting to another component or ground. The second technique is to design the entire system such that isolation is not required by using components which are rated for large power dissipation such that they themselves are considered infallible.

One problem with both of these techniques is that they require a sufficiently large transmitter housing to provide the required spacing between components or the relatively large size of the high power components. Thus, reduction in transmitter size has been limited when complying with Intrinsic Safety requirements using the above two techniques.

SUMMARY OF THE INVENTION

The present invention provides a technique for meeting Intrinsic Safety requirements using a relatively small area thereby allowing reduction in the size of the overall transmitter. The present invention is a transmitter including electronic circuitry and a bridge circuit. The electronic circuitry generates a reference level and has a process variable input for receiving an input related to the process variable. Output circuitry of the electronic circuitry transmits the process variable. The sensor bridge circuit has a sensor bridge input and a bridge output. The sensor bridge output is related to the sensed process variable. Isolation circuitry couples the electronic circuitry to the sensor bridge circuit. The isolation circuitry includes a first high impedance buffer connected to the reference level which provides a buffered reference. A first high impedance isolator couples the buffered reference to the bridge input. A second high impedance isolator couples the bridge output to a second high impedance buffer. The second high impedance buffer provides the input related to the process variable to the electronic circuitry.

DETAILED DESCRIPTION OF THE PREFERRED EMBODIMENTS

Figure 1:
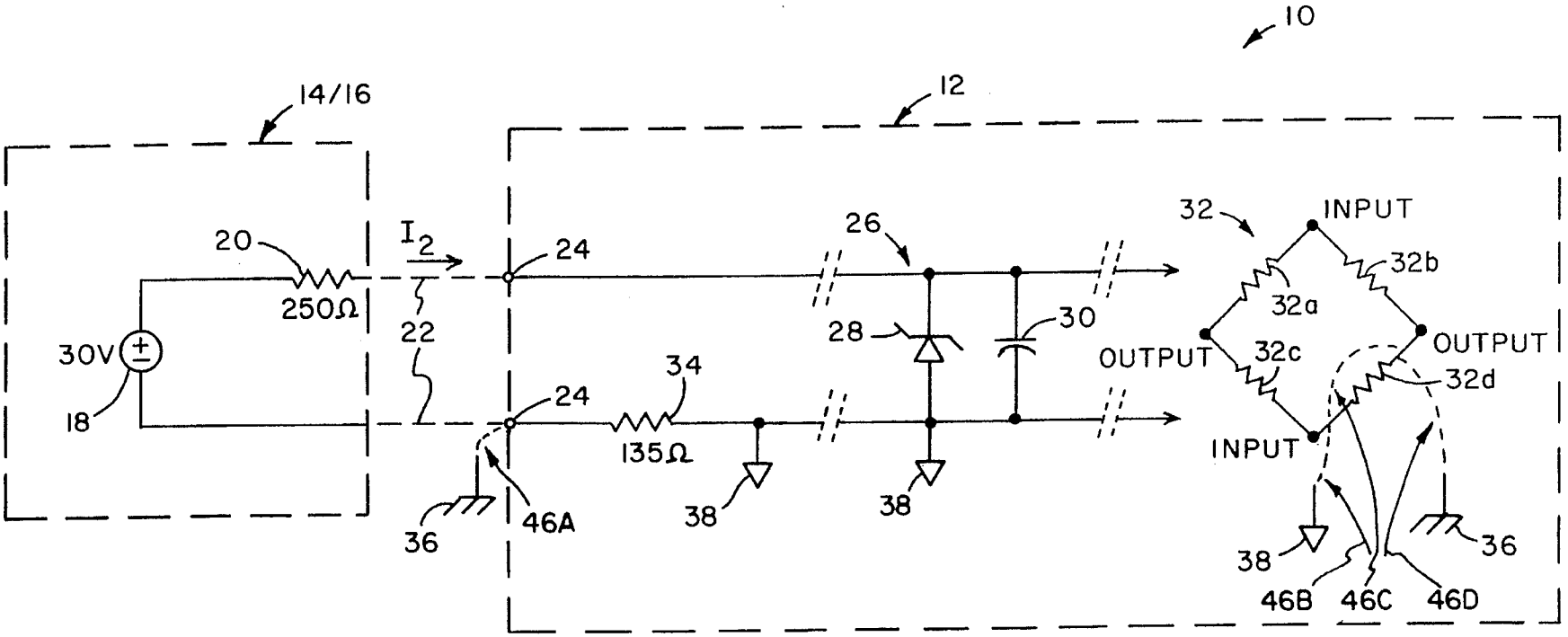
Fig. 1 PRIOR ART
FIG. 1 is a simplified schematic diagram of a process control loop illustrative of possible fault conditions for Intrinsic Safety consideration.

FIG. 1 is a simplified schematic diagram of process control system 10 which is illustrative of possible faults for Intrinsic Safety certification consideration. Process control system 10 includes a transmitter 12 located in the field in an environment which may contain explosive gases. Transmitter 12 is connected to control room 14 and barrier circuit 16 which are shown generally at equivalent circuitry 14/16 in FIG. 1. For example, barrier 16 may be a circuit including a fuse, resistors and zener diodes to limit energy transmission. Circuitry 14/16 is modeled as a 30 volt source 18 and a 250Ω resistor 20. Circuitry 14/16 connected to transmitter 12 through two-wire current loop 22 which carries loop current $I_L$. Loop 22 connects to input terminals 24 of transmitter 12. Transmitter 12 includes transmitter electronics 26 modeled generally as Zener diode 28 and capacitor 30. Electronics 26 connect to input connection IN of sensor 32 which is a resistor bridge circuit having resistors 32*a*, 32*b*, 32*c* and 32*d*. Sensor 32 also has output terminals which develop a signal therebetween in response to a sensed process variable. For example, if one of resistors 32*a*–32*d* is a resistance strain gage, bridge sensor 32 can be used to sense a process variable such as pressure.

A number of different electrical ground connections are shown in FIG. 1. Ground 36 is a chassis ground such as the chassis or body of transmitter 12. Ground 38 is a power supply voltage $V_{SS}$ which is used by internal circuitry in transmitter 12.

A power sharing resistor 34 has a resistance of 135Ω. Resistor 34 is provided such that the electronics in transmitter 12 are exposed to a limited maximum amount of the power that can be delivered to transmitter 12. The maximum power dissipation is realized when the electronics impedance $R_E$ matches the impedance of the power sharing resistor 34 and the barrier resistor 20:

$$R_E = R_{34} + R_{20} \quad \text{Eq. 1}$$

$$R_E = 135\Omega + 250\Omega = 385\Omega \quad \text{Eq, 2}$$

The total power available to the transmitter 26 will be assumed to be 0.9 W. The power sharing resistor 34 limits the maximum power $P_{MAX}$ to the remaining electronics as given by $$P_{MAX} = I_L^2 R_E \quad \text{Eq. 3}$$

$$I_L = \frac{V}{(R_{20} + R_{34} + R_E)} \quad \text{Eq. 4}$$

For the voltage source 18 equal to 30 volts as in FIG. 1, the maximum power dissipated by the electronic is given by:

$$P_{MAX} = \left( \frac{30V}{250\Omega + 135\Omega + 385\Omega} \right)^2 \cdot 385\Omega = .584W \quad \text{Eq. 5}$$

Thus, if resistor 34 is considered infallible in accordance with Intrinsic Safety requirements, the maximum power which components in transmitter 12 will be required to dissipate is 0.584 W. FIG. 1 shows example faults 46A, 46B, 46C and 46D which could occur and short electrical circuitry in transmitter 12. An intrinsically safe design isolates energy storing devices such as capacitors, batteries, inductors, or other devices. Energy storage devices can be isolated with infallible components such as resistors, series capacitors, diodes, or other devices which block or limit the energy discharge path of an energy storage device.

The present invention provides isolation circuitry (not shown in FIG. 1) between transmitter circuitry 26 and sensor bridge 32 which maintains the infallibility of power limiting resistor 34. The present invention, as described below in more detail, isolates circuitry 26 and bridge 32 using relatively large resistance values and high impedance circuitry.

Figure 2:
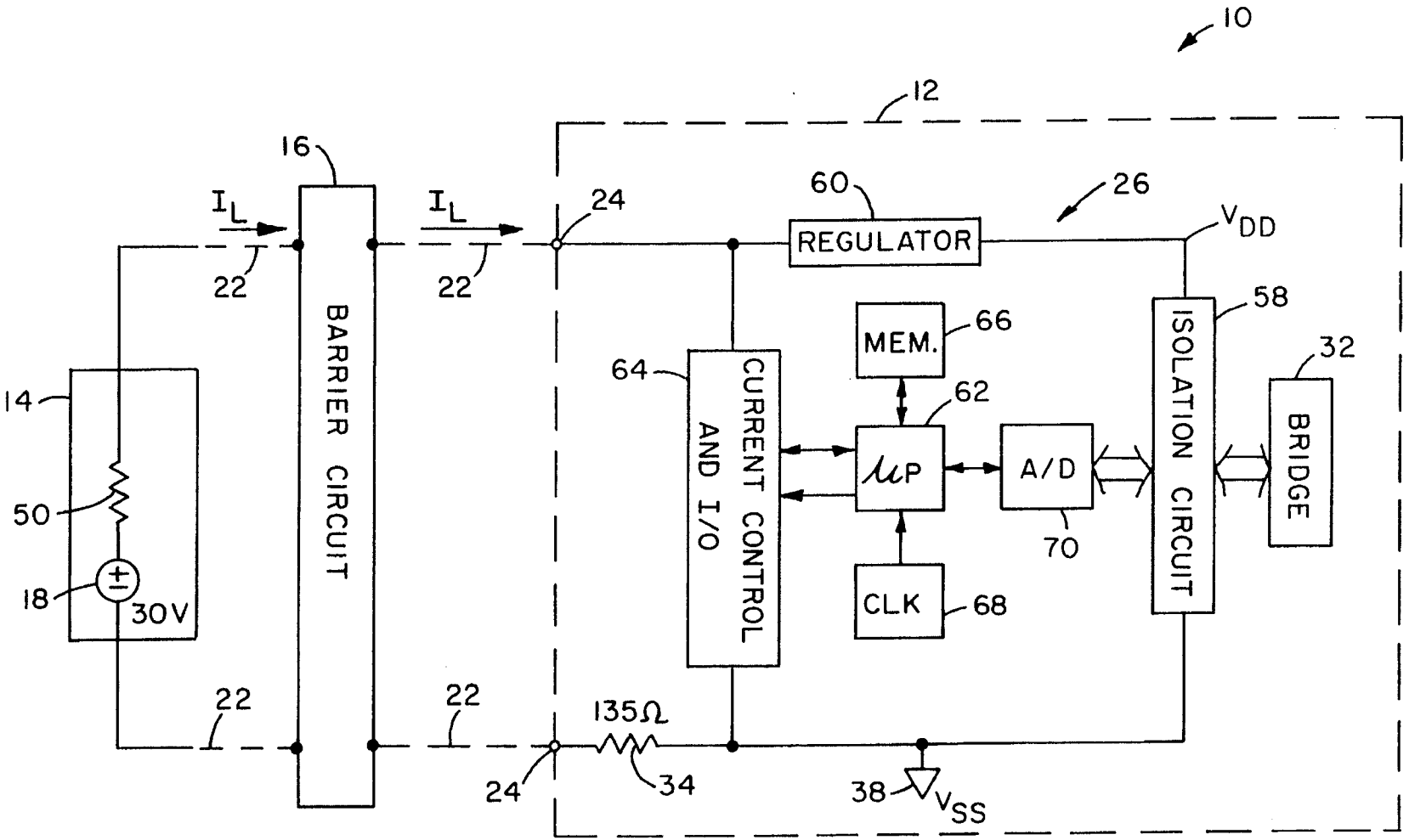
FIG. 2 is a simplified block diagram showing a transmitter in accordance with the present invention coupled to a process control loop.

FIG. 2 is a block diagram showing circuitry in transmitter 12 in greater detail. Transmitter 12 is connected to control room circuitry 14 which is modeled as resistor 50 and voltage source 18 through two-wire current loop 22. Barrier circuit 16 separates and isolates transmitter 12 from control room circuitry 14. Transmitter circuitry 26 connects to bridge 32 through isolation circuitry 58 in accordance with the invention. Transmitter circuit 26 includes voltage regulator 60, microprocessor 62 and current control and I/O circuitry 64. Voltage regulator 60 provides a regulated voltage output $V_{DD}$ with respect to $V_{ss}$ 38 to operate circuitry in transmitter 12. Microprocessor 62 connects to memory 66, system clock 68 and analog-to-digital converter 70. Microprocessor 62 operates in accordance with instructions stored in memory 66 at an operating rate determined by clock 68. Microprocessor 62 receives a process variable provided by bridge 32 through analog-to-digital converter 70 connected to isolation circuit 58. Current control and I/O circuit 64 is controlled by microprocessor 62. Microprocessor 62 adjusts loop current $I_L$ and/or sends digital representations of the process variable provided by bridge 32. Current control and I/O circuitry 64 is also used to receive information transmitted from control room 14, for example, over loop 22. This received information may comprise, for example, instructions or interrogation requests directed to microprocessor 62.

Figure 3:
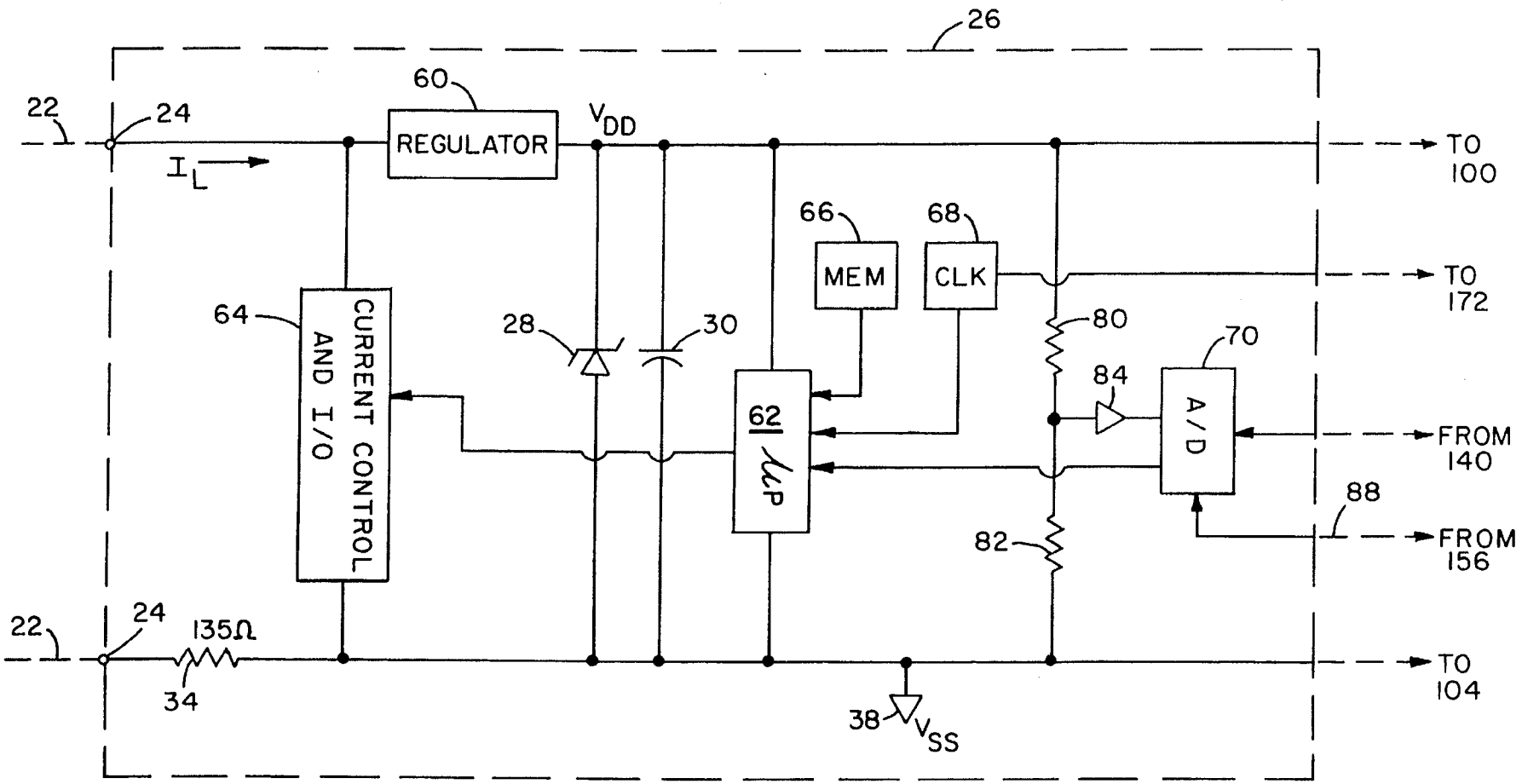
FIG. 3 is a schematic diagram of transmitter circuitry of the transmitter shown in FIG. 2.

FIG. 3 is a schematic diagram showing transmitter circuitry 26 in greater detail. Zener diode 28 clamps $V_{DD}$ at a maximum value and capacitor 30 smooths any voltage ripple on the output of regulator 60. Microprocessor 62 is powered by its connection to $V_{DD}$ and $V_{SS}$. $V_{DD}$ and $V_{SS}$ are provided to isolation circuitry 58 (shown in FIG. 4). The output from clock 68 is also provided to isolation circuitry 58. Resistors 80 and 82 develop a reference level for analog-to-digital converter 70. The reference level is buffered by buffer amplifier 84. An open sensor signal 88 from isolation circuitry 58 connects to microprocessor 62 through AD convertor 70. Analog-to-digital converter 70 receives an analog input from isolation circuitry 58.

Figure 4:
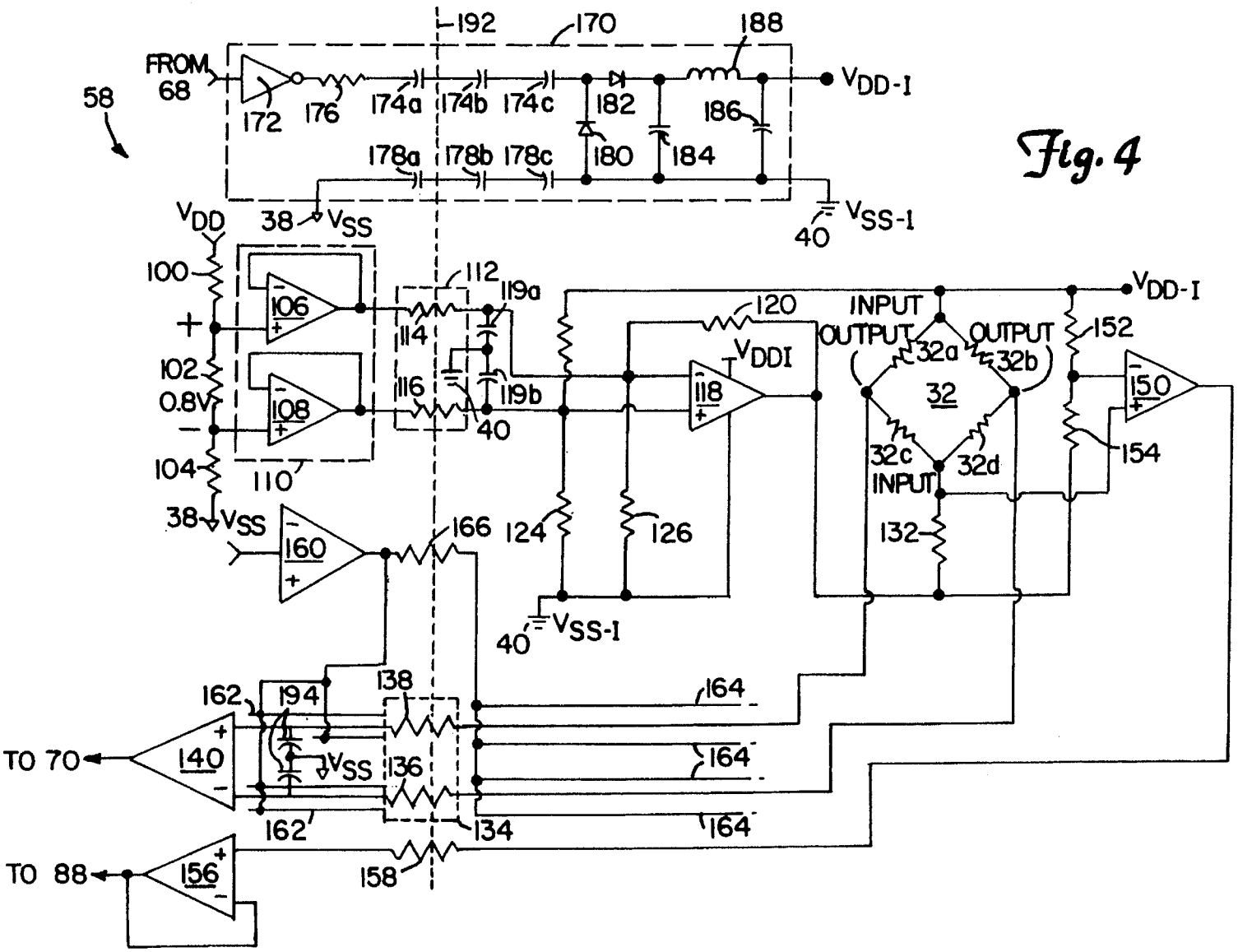
FIG. 4 is a schematic diagram of isolation circuitry coupled to a resistor bridge in accordance with the invention.

FIG. 4 is a schematic diagram of isolation circuitry 58 coupled to bridge 32 in accordance with the present invention. Isolation circuitry 58 includes resistors 100, 102 and 104 connected in series between $V_{DD}$ and $V_{SS}$ 38. Resistors 100, 102 and 104 generate a 0.8 volt nominal voltage differential which is applied to the non-inverting inputs of operational amplifiers 106 and 108. Amplifiers 106 and 108 form high impedance buffer 110. Operational amplifiers 106 and 108 are connected with negative feedback and provide unity gain amplification. The outputs of high impedance buffer 110 connect to high impedance isolator 112 which includes resistors 114 and 116. Capacitors 119*a* and 119*b* connect resistors 114 and 116 to $V_{SS-I}$ 40.

The output of high impedance isolator 112 provides a differential voltage input to operational amplifier 118 which is connected with negative feedback through resistor 120. The non-inverting input of operational amplifier 118 connects to isolated supply voltage $V_{DD-I}$ through resistor 122 and to an isolated ground $V_{SS-I}$ 40 through resistor 124. The inverting input of operational amplifier 118 connects to $V_{SS-I}$ through resistor 126. Operational amplifier 118 is connected as a differential amplifier having a gain of four.

Bridge 32 is shown with two INPUT connections. One INPUT connection is connected to the isolated supply voltage $V_{DD-I}$. The other INPUT connection is connected to the output of operational amplifier 118 through resistor 132. The outputs from bridge 32 OUTPUT are connected to high impedance isolator 134. High impedance isolator 134 includes resistors 136 and 138 which are connected to the inverting and non-inverting inputs of high impedance buffer 140, respectively. High impedance buffer 140 comprises operational amplifiers configured as a high impedance differential amplifier.

Operational amplifier 150 is connected to provide an open sensor detect output to analog to digital connector 70. Operational amplifier 150 has a non-inverting input connected to one input to bridge 32 and an inverting input connected to the isolated power supply $V_{DD-I}$ through resistor 152 and to the output of operational amplifier 118 through resistor 154. The output of operational amplifier 150 connects to high impedance buffer 156 through resistor 158. Operational amplifier 160 is driven at the common mode input voltage to operational amplifier 140 and provides a guard signal. The output of operational amplifier 160 connects to guard foils 162 and to guard foils 164 through resistor 166. Guard foils 162 and 164 run in the physical proximity of the output from bridge 32.

Power supply isolation circuitry 170 includes inverting buffer amplifier 172 connected to clock 68. The output of amplifier 172 connects to isolation capacitors 174*a*, 174*b* and 174*c* through resistor 176. $V_{SS}$ 38 connects to isolation capacitors 178*a*, 178*b* and 178*c* to provide an isolated ground $V_{SS-I}$ 40. Diodes 180 and 182 are connected to provide half wave rectification of the signal from amplifier 172. Capacitors 184 and 186 and inductor 188 are connected to provide a smooth, isolated supply voltage $V_{DD-I}$ based upon the rectified signal from amplifier 172.

In operation, the voltage $V_{DD}$ provided by regulator 66 and ground $V_{SS}$ 38 are connected through resistors 100,102 and 104 to provide a reference signal to the inputs of amplifiers 106 and 108. The voltage divider formed by resistors 100, 102 and 104 is used to keep the reference potential at a value within the common mode input range of amplifier 118. The outputs from amplifiers 106 and 108 are provided to resistors 114 and 116 which isolate the reference voltage across the line shown generally at 192. The high impedance amplifiers 106 and 108 allow use of resistors 114 and 116 which have a relatively large value. Resistors 114 and 116 are preferably metal film resistors which are considered infallible according to Intrinsic Safety requirements and have a sufficiently high value to meet Intrinsic Safety requirements. The isolated reference signal is amplified by amplifier 118 which also subtracts the isolated reference signal from the isolated supply voltage $V_{DD-I}$. This subtraction insures that the reference signal is within the output range of amplifier 118. INPUTs to bridge 32 are excited between the positive isolated supply voltage $V_{DD-I}$ and the output of amplifier 118. The output of bridge 32 is isolated by resistors 136 and 138, and amplified by differential amplifier 140. Capacitors 194 provide a filter to filter noise in the signal. Resistors 136 and 138 are of a large value to meet Intrinsic Safety requirements. In a similar manner, open sensor signal 150 is isolated using resistor 158 and buffer amplifier 156. During normal operation, the output of amplifier 156 is in a HIGH state. If bridge 32 is opened, or if power is otherwise lost to circuitry 58, the output of amplifier 156 goes to a LOW state. A low signal inhibits operation of analog to digital converter 70 which indicates a failure to microprocessor 62. Amplifier 160 and resistor 166 are used to provide a guard to the output from bridge 32 and are connected to guard foils 162 and 164. Resistor 166 is of a sufficiently large value to meet Intrinsic Safety criteria.

Power supply isolation circuitry 170 uses three series capacitors 174*a*, 174*b*, 174*c* to isolate the supply voltage $V_{DD-I}$ and uses three series capacitors 178*a*, 178*b*, 178*c* to isolate ground. Three series capacitors are considered infallible in accordance with Intrinsic Safety standards. The periodic signal output from clock 68 passes through capacitors 174*a–c* or 178*a–c*. The clock signal is rectified and filtered using diodes 180 and 182, capacitors 184 and 186, and inductor 188. The clock signal is at a relatively high frequency, for example 460 KHZ, such that the filter components can be relatively small. However, values should be selected which provide a current supply capacity of at least 120 μA plus sufficient current to power bridge 32 for a total of about 400 μA.

The parallel combination of all six isolation resistors 114, 116, 166, 138, 136 and 158 is selected such that it is greater than 16Ω. This relatively large value is insignificant in comparison to the 135Ω power limiting resistor 34. The signal used to drive bridge 32 is proportional to the same reference provided to analog-to-digital converter 70 shown in FIG. 2. Therefore, variations in $V_{DD}$ are reflected in the drive signal (IN) applied to bridge 32. Such that an error is not introduced into the output of analog-to-digital converter 70.

In one preferred embodiment, components of isolation circuitry 58 are as follows:

TABLE 1

| Component | Value |
|---|---|
| Resistor 100 | 200 KΩ |
| Resistor 102, 104 | 49.9 KΩ |
| Resistors 114, 116 | 169 KΩ |
| Resistors 120, 122, 124, 126 | 681 KΩ |

TABLE 1-continued

| Component | Value |
|---|---|
| Resistor 132 | 100 Ω |
| Resistors 136, 138 | 52.3 KΩ |
| Resistor 152 | 158 KΩ |
| Resistor 154 | 648 KΩ |
| Resistors 158, 166 | 169 KΩ |
| Resistor 176 | 12.1 Ω |
| Capacitors 176a–c and 178 a–c | 0.022 μF |
| Capacitors 184, 186 | 0.033 μF |
| Inductor 188 | 220 μH |

Operational amplifiers 106 and 108 are Texas Instrument TLC27L2 (dual); 118 and 150 are Texas Instrument TLV2252 (dual); 140 and 156 are a Texas Instrument TLC2254 (quad).

The present invention provides a unique technique for isolating transmitter electronics from a bridge circuit in a process control transmitter. The technique uses high impedance elements and high impedance amplifiers to provide Intrinsically Safe isolation between components. A capacitively isolated power is used to provide power to the bridge circuitry and isolation circuitry.

Although the present invention has been described with reference to preferred embodiments, workers skilled in the art will recognize that changes may be made in form and detail without departing from the spirit and scope of the invention. For example, different types of high impedance buffers or high impedance isolators may be employed and other types of sensors such as a semiconductor temperature sensor, capacitor, vibrating beam, optical, piezoelectric, and magnetic may be utilized. Further, the power signal can be any AC signal and is not limited to a clock signal.

What is claimed is:

1. A transmitter for sensing and transmitting a process variable, comprising:

electronic circuitry comprising:

process variable input circuitry for receiving an input related to the process variable; and output circuitry transmitting the process variable;

a reference level generator generating a reference level;

a sensor having a sensor output related to the sensed process variable;

isolation circuitry coupling the sensor to the electronic circuitry comprising:

a first high impedance buffer connected to the reference level providing a buffered reference; and a first high impedance isolator coupling the buffered reference to an input of the sensor.

2. The transmitter of claim 1 wherein the isolation circuitry further includes:

a second high impedance buffer coupling the buffered reference to an input of the sensor;

a second high impedance isolator coupled to the sensor output; and a second high impedance buffer coupling the second high impedance isolator to the process variable input circuitry.

3. The transmitter of claim 2 wherein the second high impedance buffer comprises a differential amplifier and the second high impedance isolator comprises a first resistor connected between an input to the differential amplifier and the output of the sensor and a resistor connected between a second input to the differential amplifier and the output from the sensor.

4. The transmitter of claim 1 including an amplifier connected between the first high impedance isolator and the sensor input.

5. The transmitter of claim 1 wherein the first high impedance buffer comprises a first operational amplifier and a second operational amplifier and the first high impedance isolator comprises a first resistor connected in series with an output of the first operational amplifier and a second resistor connected in series with the output of the second operational amplifier.

6. The transmitter of claim 1 wherein the process variable input circuitry of the electronic circuitry includes an analog-to-digital converter for receiving the input relating to the process variable, the analog-to-digital converter including a reference level input generated from the reference level whereby changes in the buffered reference are reflected in the reference level input to the analog-to-digital converter.

7. The transmitter of claim 1 wherein the electronic circuitry includes a clock and the isolation circuitry includes power isolation circuitry which generates an isolated power supply using a clock signal from the clock.

8. The transmitter of claim 7 wherein the power isolation circuitry includes a plurality of capacitors connected in series with the clock signal providing the isolated power supply.

9. The transmitter of claim 8 including a rectifier and filter circuit connected to the plurality of capacitors to rectify and filter the isolated power supply.

10. The transmitter of claim 1 wherein the isolating circuitry includes an open sensor detector providing an open sensor output to a third high impedance isolator responsive to an open sensor condition of the sensor.

11. The transmitter of claim 1 including a high impedance guard isolator connected to guard foil proximate the output from the sensor.

12. The transmitter of claim 1 wherein the sensor is a bridge circuit.

13. A transmitter for sensing and transmitting a process variable, comprising:

circuitry for receiving an input related to the process variable and transmitting the process variable;

an AC signal source for generating an AC signal;

a process variable sensor providing an output to the transmitter circuitry in response to the process variable;

sensor circuitry coupled to the process variable sensor used in operation of the sensor;

sensor power supply circuitry comprising:

at least three capacitors connected in series and coupled to the AC signal source, the capacitors allowing pressure of the AC signal and blocking passage of the DC signal;

a rectifier connected to the AC signal source through the three capacitors for rectifying the AC signal;

a holding capacitator connected in parallel with the rectifier providing an isolated power source for the process variable sensor; and a filter coupled to the holding capacitor providing a substantially DC power supply output to the sensor circuitry.

14. The transmitter of claim 13 including:

a high impedance isolator coupled to the process variable sensor output; and a high impedance buffer coupling the high impedance isolator to transmitter circuitry.

15. The transmitter of claim 13 including:

a reference level generator providing a reference level;

a high impedance buffer coupled to the reference level;

a high impedance element coupling the high impedance buffer to the process variable sensor thereby providing a buffered reference level.

16. The transmitter of claim 15 including:

an analog-to-digital converter for converting the process variable output to a digital value, the analog to digital converter responsive to the reference level whereby changes in the buffered reference level are reflected in operation of the analog-to-digital converter.

17. The transmitter of claim 13 wherein the AC signal source is a clock.

18. The transmitter of claim 13 including a high impedance element connected to an open sensor signal from the process variable sensor.

19. The transmitter of claim 13 including a high impedance guard isolator connected to guard foil proximate connections to the output from the process variable sensor.

20. The transmitter of claim 13 wherein the process variable sensor comprises a bridge circuit.

* * * * *

UNITED STATES PATENT AND TRADEMARK OFFICE

CERTIFICATE OF CORRECTION

PATENT NO. : 5,610,552

DATED : March 11, 1997

INVENTOR(S) : Morton L. Schlesinger et al.

It is certified that error appears in the above-indentified patent and that said Letters Patent is hereby corrected as shown below:

Col. 8, line 6, delete "pressure" and insert therefore --passage--.

Signed and Sealed this

Thirtieth Day of December, 1997

*Attest:*

*Attesting Officer*

BRUCE LEHMAN

*Commissioner of Patents and Trademarks*